United States Patent [19]

Ballantyne

[11] Patent Number: 4,852,320

[45] Date of Patent: Aug. 1, 1989

[54] MORTAR COLLECTING DEVICE FOR USE IN MASONRY WALL CONSTRUCTION

[76] Inventor: Brian R. Ballantyne, 18 Markdale Ave., Toronto, Ontario, Canada, M6L 1S9

[21] Appl. No.: 185,053

[22] Filed: Apr. 19, 1988

[51] Int. Cl.[4] ..... E04B 1/70

[52] U.S. Cl. ..... 52/303; 52/379; 52/513; 52/562

[58] Field of Search ..... 52/379, 383, 310, 169.5, 52/380, 381, 382, 302, 303, 744, 749, 513, 562, 565, 303

[56] References Cited

U.S. PATENT DOCUMENTS

| | | | |
|---|---|---|---|
| 957,382 | 5/1910 | Schnurr | 52/513 |
| 1,486,935 | 3/1924 | Swanson et al. | 52/677 |
| 1,697,760 | 1/1929 | Foans | 52/565 |
| 1,794,684 | 3/1931 | Handel | 52/379 |
| 3,217,457 | 11/1965 | Naar | 52/565 |
| 4,282,691 | 8/1981 | Risdon | 52/303 X |
| 4,606,163 | 8/1986 | Catani | 52/513 X |
| 4,622,796 | 11/1986 | Aziz et al. | 52/562 X |
| 4,765,115 | 8/1988 | Pollina | 52/562 X |

FOREIGN PATENT DOCUMENTS

| | | | |
|---|---|---|---|
| 36580 | 5/1935 | Netherlands | 52/303 |

*Primary Examiner*—Carl D. Friedman
*Assistant Examiner*—Lan Mai
*Attorney, Agent, or Firm*—Riches, McKenzie & Herbert

[57] ABSTRACT

A mortar collecting device adapted to be located adjacent a wall surface of a masonry or brick wall under construction and collect excess mortar extruded from between rows of masonry during construction of the wall. Such mortar collecting devices each posses an upper surface means adapted to collect mortar but repel moisture in the form of water droplets which falls on such surface means. Repulsion of water is accomplished by providing an upper surface means having an inclined portion sufficiently inclined to the horizontal when such device is in mortar collecting position so as to cause moisture to slide off, but being insufficiently inclined so as to cause mortar to slide off. Alternatively the mortar collecting device may have a plurality of passageway means extending vertically therethrough of dimensions sufficient to allow moisture to pass therethrough, but of dimensions insufficient to allow mortar to pass therethrough.

16 Claims, 6 Drawing Sheets

MORTAR COLLECTING DEVICE FOR USE IN MASONRY WALL CONSTRUCTION

INTRODUCTION

This invention relates to a mortar collecting device, more particularly to a device adapted to be located adjacent an inner surface of a masonry wall under construction to collect excess uncured mortar extruded from between masonry brick located above said mortar collecting device.

BACKGROUND OF THE INVENTION

Generally, exterior masonry wall surfaces for buildings are constructed in conjunction with a structural inner wall which serves as the main supporting wall. Such inner structural wall is usually comprised of either (1) a frame wall (wood or steel studs, with an inner surface of drywall or some interior finish) or (2) concrete blocks, placed together to form such inner wall, and spaced apart from the exterior masonry wall, or (3) a concrete shear wall, in a wall construction technique commonly known as cavity wall construction Between the exterior masonry wall, and the inner structural wall there generally exists an air space, which insulation may partially fill.

In rain screen construction, weep-hole ventilators (porous blocks) are located in spaced intervals along the lower masonry row of each floor level of an exterior masonry wall, allowing air communication from the exterior to the interior cavity. These weep-hole ventilators serve a dual purpose. Firstly, such weep-hole ventilators serve to equalize the air pressure on both sides of the masonry wall (i.e. the exterior and interior masonry wall surfaces) by allowing air to pass therethrough to equalize the air pressure in the cavity and the exterior. Secondly, weep hole ventilators allow moisture which may have condensed on the inner masonry wall surface, and trickled down to the lower brick row level, to flow through such ventilators to the outside of the masonry wall. This prevents entrapment of moisture in the cavity immediately adjacent the inner wall surface of the exterior masonry wall, and further serves to prevent moisture permeation of the insulation located in the cavity adjacent the inner structural wall.

Should, however, moisture be allowed to remain on the inner wall surface of the exterior masonry wall, (i.e. in the interior cavity) it may seep to the exterior surface of the masonry wall from the interior wall surface thereof through the masonry bricks comprising the masonry wall. This is very undesirable, since the evaporating moisture from the exterior surface of the brick leaves deposited minerals thereon, causing the common unsightly "whitening" of the exterior masonry wall surface in a process called efflorescence.

Also, should moisture be allowed to remain in the cavity, and continue to seep through the masonry wall from the interior to the exterior, such moisture may at some point freeze, causing cracks in the masonry wall due to the force of expansion of the frozen moisture. This is also very undesirable.

The problems of efflorescence, moisture seepage through the masonry wall, and frost cracking, have commonly been overcome by proper ventilation of the cavity by use of a plurality of weep hole ventilators along the bottom row surface of the masonry wall.

Frequently, however, during construction of such masonry walls, excess mortar used in cementing masonry bricks one to another is extruded from between such mortar joints, and falls within the cavity space to the lower brick row level, where the weep-hole ventilators are located. Any excess mortar on the exterior surface side of the brick wall may easily be removed. However, in cavity wall construction or composite wall construction, excess mortar piles up at the base of the masonry wall in the interior cavity, intermediate the outer and inner walls, where the weep-hole ventilators are located, causing the weep-hole ventilators to become plugged.

This situation is highly undesirable, for the reasons mentioned above, but also for the further reason that moisture may begin to accumulate at the bottom of the cavity, being unable to escape to the exterior because of the plugged weep-hole ventilators. Although galvanized metal flashing is usually provided along the bottom surface of the outer masonry wall, accumulated moisture may then seep through seams in such flashing and through the insulation, and into the inner structural wall. For obvious reasons, this is also undesirable.

Building contractors and architects have recognized this problem, and some techniques have been used to attempt to deal with such problem.

One such early method involved placing a removable trowel, or mortar-collecting device, along the bottom row on the interior side of the masonry wall under construction, to which ropes were attached. During construction of the masonry wall, any extruded mortar fell onto the mortar-collecting device. Upon construction of the wall, the device containing extruded mortar was pulled up from the interior cavity by means of the ropes, and the excess mortar was thereby removed.

Recently, however, building codes require that re-inforcing material having closed loop protrusions, or reinforcing ties which extend intermediate the inner and outer wall surfaces at spaced intervals be provided to allow the outer masonry wall to thereby be "tied" to the interior structural wall. This re-inforcing material may have inwardly protruding ties, frequently in the form of closed loop stirrup members and commonly 3/16" diameter steel wire, which thereby prevent the trowel from being removed from the interior cavity, since the inwardly protruding "ties" prevent the trowel from being pulled upward by the ropes and thereby from being removed from the cavity.

Another practice employed in the industry involves use of a series of corrugated water-resistant material placed adjacent the inner wall surface of the masonry wall, and overlying such surface. These corrugated overlying materials are placed between horizontal rows of protruding closed loop stirrup members along the wall and are pressed against such surface usually by insulation within the inner cavity.

Such horizontally corrugated overlying materials are partially effective in preventing excess extruded mortar from falling to the base level row of bricks, and thus prevent plugging of the weep hole ventilators. However, the primary purposes of such devices is to increase the insulation capability of the wall by trapping air pockets along the horizontal corrugations, and provide a waterproof barrier to prevent insulation from contacting a moist inner wall surface of the masonry wall, upon which moisture may have condensed. Such horizontal corrugations pose a problem, however, in that they also prevent moisture which condenses on the interior wall surface from trickling downwardly to the weep-hole ventilators. This allows the moisture to collect in the horizontal corrugations, and the problem of moisture seepage to the exterior masonry wall surface, and the problems of efflorescence and frost cracking, described above, are not overcome. Moreover, the quantity of material necessary to cover the inner wall surface requires costly expenditure in terms of material.

SUMMARY OF THE PRESENT INVENTION

In order to at least partially overcome the problem of excess mortar extruded from between masonry bricks falling to the bottom base row of an exterior masonry wall under construction, and thereby plugging the weep-hole ventilators connecting the interior wall cavity with the exterior, a plurality of mortar collecting devices are provided each adapted to be located adjacent the inner wall surface of an exterior masonry wall under construction to reduce the amount of buildup of fallen mortar at the weep-hole ventilator level and thereby reduce plugging of weep-hole ventilators.

It is contemplated that a mortar collecting device may be used in any kind of masonry wall construction. Such masonry walls may be comprised of bricks, stones, tiles, or other forms of masonry held together by mortar, cement, or other similar binding substance.

Accordingly, a mortar collecting device for use in construction of a masonry wall is provided, such device in a first embodiment thereof comprising: a substantially planar end surface adapted for placement adjacent a wall surface of said masonry wall; engagement means adapted to engage re-inforcing material protruding from the wall surface of the masonry wall to allow support of said mortar collecting device by said reinforcing material; upper surface means, an inclined portion of which is horizontally inclined when said mortar collecting device is located adjacent a masonry wall, said inclined portion being inclined at an angle sufficient to shed moisture in the form of water droplets and prevent any substantial amount of said moisture from accumulating on said upper surface means, said inclined portion being sufficiently horizontal to allow retention of mortar falling thereon.

Alternatively, in a second embodiment of the present invention, the mortar collecting device need not possess engagement means adapted to engage re-enforcing material protruding from the inner wall surface, but may alternatively possess attachment means outwardly protruding from the planar end surface at approximately a 90° angle therewith and integral with the mortar collecting device. Such attachment means are adapted to be cemented within mortar placed intermediate masonry bricks during construction of the masonry wall to affix the mortar collecting device at any desired location on the masonry wall.

Furthermore, in a third embodiment of the invention, a mortar collecting device in kit form is provided, the kit comprising: a mortar collecting device, said device comprising: (i) a substantially planar end surface adapted for placement against a wall surface of a masonry wall; (ii) upper surface means, inclined portions of which ar horizontally inclined when said mortar collecting device is affixed to a brick wall, said inclined portions being inclined at an angle sufficient to shed moisture in the form of water droplets and prevent any substantial amount of said moisture from accumulating on said upper surface means, said inclined portions being sufficiently horizontal to allow retention of excess mortar falling thereon; and connection means adapted affix said mortar collecting device to said wall.

In a preferred aspect of the above embodiments, the device is substantially prismatic in shape having three sides, one of the three sides of the device forming a base side, and at least one of the remaining two sides adjacent said base side forming the upper surface means adapted to collect uncured mortar thereon.

It is further provided that a mortar collecting device in any of the embodiments described above may further comprise a plurality of second Passageway means aligned in a substantially vertical direction when the mortar-collecting device is located adjacent said masonry wall, and extending through said device, said second passageway means each having a cross-sectional area sufficiently small to substantially prevent passage of uncured mortar therethrough but of sufficient cross-sectional area to permit passage of moisture therethrough. In a preferred embodiment the second passageway means are comprised of a plurality of vertically aligned parallel rows of passageways. Such configuration permits mortar to be retained on the upper surface means of the mortar collection device, and not only permits any moisture trapped on the upper surface means, on the inclined portion thereof, to pass through said second passageway means, but further allows any moisture which becomes deposited on said mortar to be shed because of the incline of said upper surface means.

In yet a further embodiment, it is not necessary that portions of the upper surface means be inclined to the horizontal when the mortar collecting device is positioned adjacent the wall in order to give the mortar collecting device its water shedding properties, where provision is further made for the incorporation of a plurality of second passageway means extending through the mortar collecting device in a substantially vertical direction, as previously described. Such second passageway means each possess a cross-sectional area large enough to allow moisture condensing on the inner wall surface to which the device is affixed to pass through, and thus trickle downwardly from the mortar collecting device to weep-hole ventilators located in the wall. Such second passageway means are, however, sufficiently small in cross-sectional area to substantially prevent passage of uncured mortar therethrough. Thus moisture accumulation on the upper surface means is still prevented where second passageway means are provided, even though the upper surface means may not possess an inclined portion. Similarly, in a preferred embodiment the second passageway means are comprised of a plurality of vertically aligned parallel rows of passageways.

More particularly, the above embodiment of the present invention comprises a mortar collecting device adapted to collect mortar during construction of a masonry wall, comprising: upper surface means adapted to collect mortar; a substantially planar end surface adapted for placement against a wall surface of a masonry wall; engagement means adapted to engage reinforcing material protruding from the wall surface of the masonry wall to allow support of said mortar collecting device by said reinforcing material; and a plurality of second passageway means extending in a substantially vertical direction when said device is located adjacent the wall surface, said passageway means each having a cross-sectional area sufficiently small to substantially prevent passage of uncured mortar therethrough but of sufficient cross-sectional area to permit passage of moisture therethrough.

In an alternative embodiment, where it is desired to locate mortar collecting devices on the innér wall surface in positions other than at mutual pairs of spaced apart protruding ties, the engagement means on each mortar collecting device of this last embodiment may be replaced by outwardly protruding attachment mean which allow attachment of said mortar collecting device at such other locations, as previously described.

In a further embodiment, where no integral attachment means are provided, a kit may be provided comprising the mortar collecting device and connection means to allow attachment of the mortar collecting device at locations other than on re-inforcing material protruding from the inner masonry wall surface.

According to this last embodiment, a kit may be provided for affixing a mortar collecting device to a masonry wall, comprising: (i) a substantially planar end surface adapted for placement against a wall surface of a masonry wall; (ii) upper surface means adapted to collect excess mortar falling thereon; (iii) a plurality of second passageway means extending through said device in a substantially vertical direction when such device is located adjacent a wall surface, said second passageway means each having a cross-sectional area sufficiently small to substantially prevent passage of uncured mortar therethrough but of sufficient cross-sectional area to permit passage of moisture therethrough; and connection means for affixing said mortar collecting device to said wall.

As a further refinement of the present invention in kit form, it is further contemplated that the mortar collecting device further comprise first passageway means extending substantially perpendicular to the plane of the end surface, wherein the connection means further comprises: (i) a head portion of a size sufficient to prevent passage through said first passageway means; (ii) a stem portion at one end to said head portion, said stem portion at an end opposite said head portion adapted to be inserted through said first passageway means in said mortar collecting device and into uncured mortar in said masonry wall thereby cementing said connecting means intermediate masonry brick and affixing said mortar connecting device to said masonry wall.

It is contemplated that the material of which each mortar collecting device is comprised to be an inexpensive, non-water absorbent material, such as a plastic, or certain types of non-absorbent polystyrene. In a preferred aspect, the mortar collecting device of each of the above-described embodiments is comprised of a polyethylene material. It is further possible such mortar collecting device be comprised of an inexpensive injection-molded plastic.

BRIEF DESCRIPTION OF THE DRAWINGS

Further objects and advantages will appear from the following detailed description of the invention, taken together with the accompanying drawings in which.

DETAILED DESCRIPTION OF THE DRAWINGS

Figure 1:
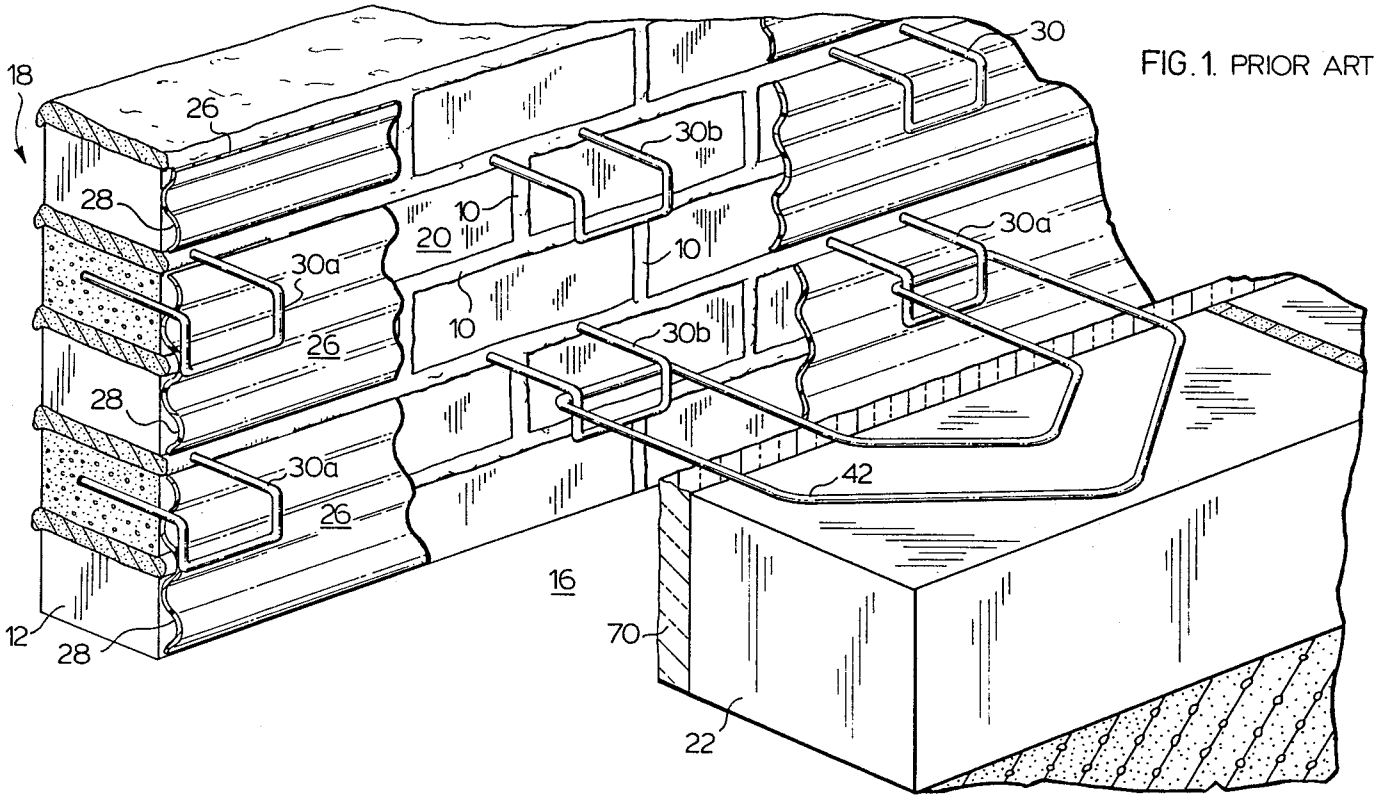
FIG. 1. PRIOR ART
FIG. 1 is a perspective view of a plurality of prior art devices located along an inner wall surface of a masonry wall under construction.

Brick walls 18, such as the brick walls under construction, as shown in FIGS. 1, 2, 3, 7, 8 & 10, commonly tend to extrude uncured mortar 10 from between rows of masonry brick when one row of bricks is placed upon, and cemented to, an underlying row of bricks during construction of such wall. Such extruded mortar 10 commonly falls to the level of the base row 12 of masonry brick where weep hole ventilators 14, which are porous blocks designed to provide air communication to the interior cavity 16 of a masonry wall 18 under construction, are located. This extruded mortar may then cause the weep hole ventilators 14 to become plugged due to a pile-up of extruded mortar on the inner wall surface 20 along the base row 12 of masonry brick, which later hardens and effectively plugs the weep-hole ventilators 14. Although such excess piled-up mortar 10 may be easily removed from the exterior wall surface of the masonry wall 18, no access is possible to the inner wall surface 20 of the masonry wall, due to the simultaneous construction or pre-construction of an interior structural wall 22, as occurs in cavity wall construction (see FIG. 3), or due to the erection of studs, insulation 70, and an interior wall surface 24 as occurs in composite wall construction (see FIG. 8). Thus no removal of excess piled up mortar 10 is possible from the inner wall surface 20, and the weep-hole ventilators 14 frequently become plugged with excess mortar. Plugged weep-hole ventilators 14 result in problems of frost cracking, efflorescence, and moisture penetration through the inner structural wall 22, as described above.

The problem of uncured extruded mortar 10 falling to the base row 12 of masonry brick, and thereby plugging the weep hole ventilators 14 has been partially overcome in the prior art by use of overlying material 26 having horizontal corrugations 28 which are located adjacent to the inner wall surface 20, of the masonry wall 18, as shown in FIG. 1. Such overlying materials 26, usually located intermediate rows of spaced apart closed loop stirrup members 30*a,b* primarily serve the purpose of providing greater insulation in the inner wall cavity, and also prevent insulation 70 within the cavity 16 from contacting the inner wall surface 20 of the brick wall 18 and thereby absorbing moisture which may have condensed on the inner wall surface 20. Such overlying materials 26, however, also incidentally serve to partially prevent uncured mortar 10 from falling by trapping such mortar 10 within the horizontal corrugations 28. The disadvantage, however, of such overlying materials 26 is that moisture condensation on the inner wall surface 20 of the brick wall 18 is liable to become trapped in the horizontal corrugations, causing the problem of moisture permeation through the exterior bricks on the brick wall surface 18 and resultant frost cracking of the brick wall 18, as well as whitening of the exterior surface as a result of efflorescence.

Moreover, overlying of the entire inner wall surface 20 with overlying material 26 is necessarily expensive relative to the device of the present invention disclosed herein, which has none of the disadvantages of moisture entrapment described above.

Thus the above described prior art is unsatisfactory in providing a means of preventing buildup of excess mortar without the serious disadvantages described above.

Figure 2:
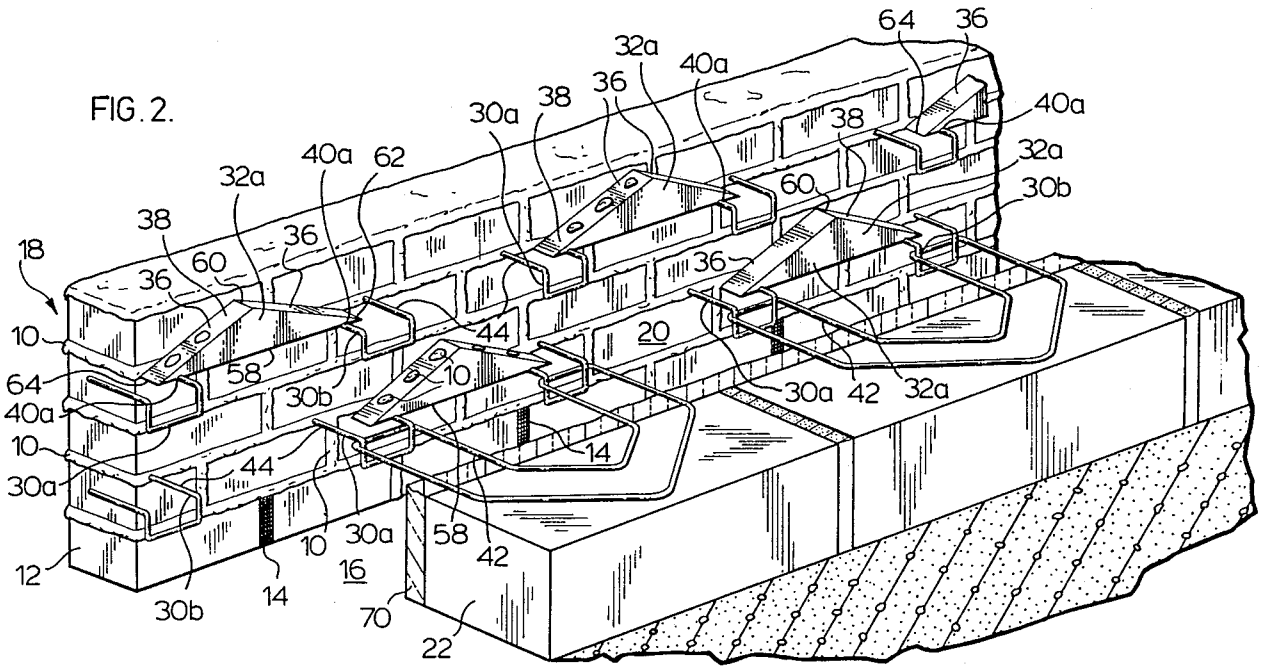
FIG. 2 is a perspective view of a masonry wall during construction showing a plurality of mortar collecting devices of the present invention in one embodiment thereof.

Accordingly, FIG. 2 shows a plurality of mortar collecting devices 32 of the present invention, in one embodiment 32*a* thereof, arranged in mortar collecting position along the inner wall surface 20 of the brick wall 18, each located along pairs of mutually spaced apart closed loop stirrup members 30*a* and 30*b* protruding from the inner wall surface 20 of the brick wall 18.

Each wall of said mortar collecting devices 32 comprises a substantially planar end surface 34 (shown more clearly in FIG. 3–6, & 8–10) adapted for placement adjacent an inner wall surface 20 of the brick wall 18. Such mortar collecting devices 32 further comprise an upper surface means 36 having an incline portion 38. This inclined portion or portions 38 are inclined to the horizontal, when the mortar collecting device 32 is affixed to the masonry wall.

Figure 5:
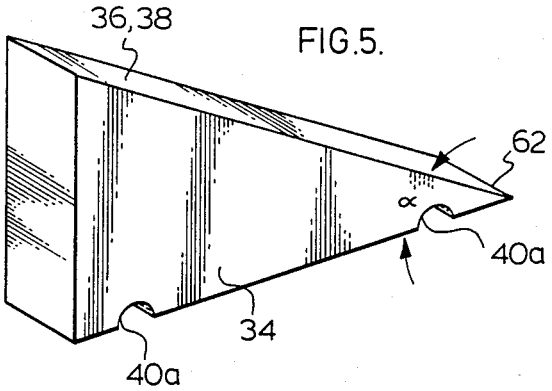
FIG. 5 is a perspective view of yet another embodiment of the mortar collecting device of the present invention.
Figure 6:
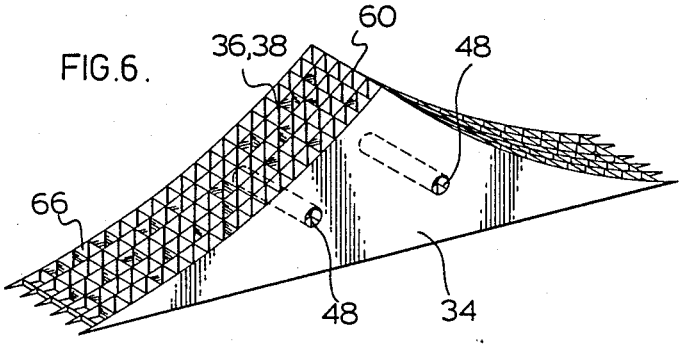
FIG. 6 is a perspective view of yet a still further embodiment of the mortar collecting device of the present invention adapted for use with connection means for affixation to the inner wall surface of a masonry wall under construction.

The inclined angle alpha as shown in FIG. 5, may be a constant value, or increase or decrease over the length of the inclined portion, as shown in FIG. 6. However, said inclined portion or portions 38 of upper surface means 36 are inclined at angles alpha sufficient to shed moisture in the form of water droplets and prevent any substantial amount of said moisture from accumulating on said upper surface means, but are sufficiently horizontal to allow retention of excess mortar falling thereon when the mortar 10 is extruded from between masonry bricks during cementing of bricks in rows vertically above the location of the mortar collecting device on the brick wall 18, as shown in FIG. 2.

Thus because of the incline of the inclined portion 38, water is easily shed from the upper surface means 36 of the mortar-collecting devices 30. However, since the inclined portion 38 is insufficiently inclined to the horizontal to shed the more viscous uncured mortar 10, such mortar will tend to remain, and harden, on such inclined portion 38 of the upper surface means 36. Usually, where the inclined portion 38 is a planar surface, as shown in FIGS. 2,4,7,9 and 10, it has been found that an incline to the horizontal of between approximately 2° and 45° is sufficient to repel moisture from the inclined portion 38 of the upper surface means 36, but not great enough to shed the more viscous uncured or cured mortar, which has a greater resistance to flow. At angles alpha of greater than approximately 45° uncured mortar tends to slide off the inclined portion 36, which, if the entire upper surface means was inclined at greater than about 45°, would render such mortar collecting devices 32 ineffective.

Of course, portions of the upper surface means 36 may be inclined at angles alpha of greater than 45° as shown in FIG. 6. However, in the embodiment described above, it is necessary that upper surface means 36 each possess an inclined portion 38, wherein the angle of incline of such inclined portion 38 to the horizontal at any point along such inclined portion 38 is sufficient to repel moisture, and collect mortar thereon, such angles usually being between 2° and 45°, depending upon the surface adhesion between the uncured or cured mortar 10 and the surface of the inclined portion 38.

Figure 4:
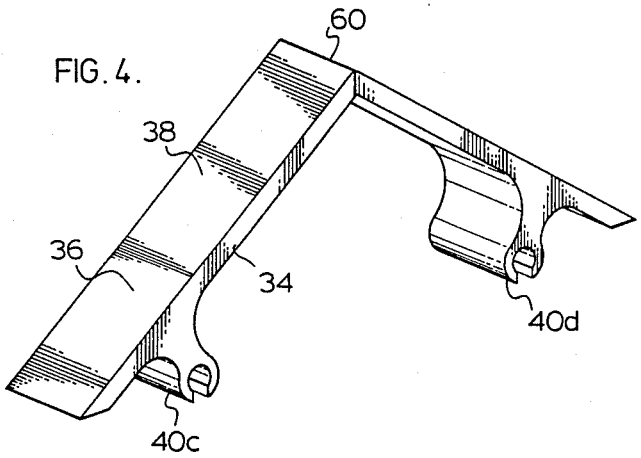
FIG. 4 is a perspective view of a further embodiment of the mortar collecting device of the present invention.

In regard to the manner of locating the mortar collecting devices 32 on the brick wall surface 18, it is further contemplated the mortar collecting devices 32 each possess engagement means 40, various configurations of which are shown in FIGS. 2,4, and 5, each adapted to allow engagement of said mortar collecting device with reinforcing material 30 protruding from the inner wall surface 20 of the brick wall 18 to allow support of said mortar collecting device by said re-inforcing material. Such engagement means 40 may be nothing more than an abutting portion 4*a,b* on the lower surface of the mortar collecting device 32 to allow mortar collecting device to rest upon the protruding re-inforcing material 30. Where the re-inforcing material comprises pairs of spaced apart closed loop stirrup members 30*a,b* located along a row of bricks, the engagement means 40 may comprise an abutting portion 40*a,b* on opposite ends of the mortar collecting device 32 to engage respective pairs of closed loop stirrup members 30*a*,30*b*.

Further, such engagement means 40 in the form of abutting portions may further comprise grooved portions 40*a,b* to allow positive engagement with the closed loop stirrup members 30*a, b* as shown in FIG. 5. If a still more positive engagement means 40 is desired, a resiliently flexible engagement means 40*c,d* as shown in FIG. 4 may be affixed to the lower surfaces of the mortar collecting device 32, wherein such engagement means 40*c,d* are adapted to engage respective pairs of closed loop stirrup members 30*a*, 30*b*. Such stirrup members 30 are generally 3/16" diameter steel wire, easily engageably by an engagement means 40*c,d* as shown in FIG. 4 adapted to encircle the wire to affix the mortar collecting device 32 thereto.

Figure 3:
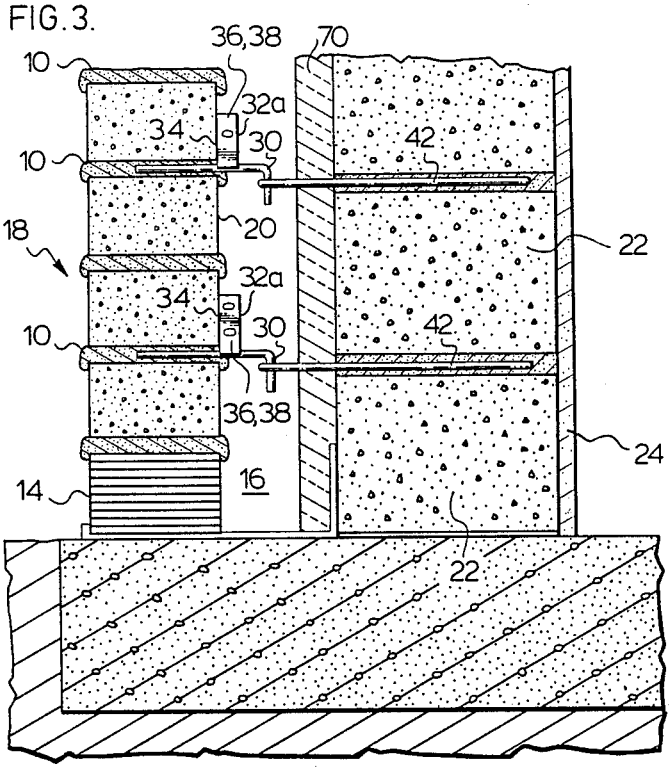
FIG. 3 is a side elevation view of the masonry wall shown in FIG. 2.
Figure 7:
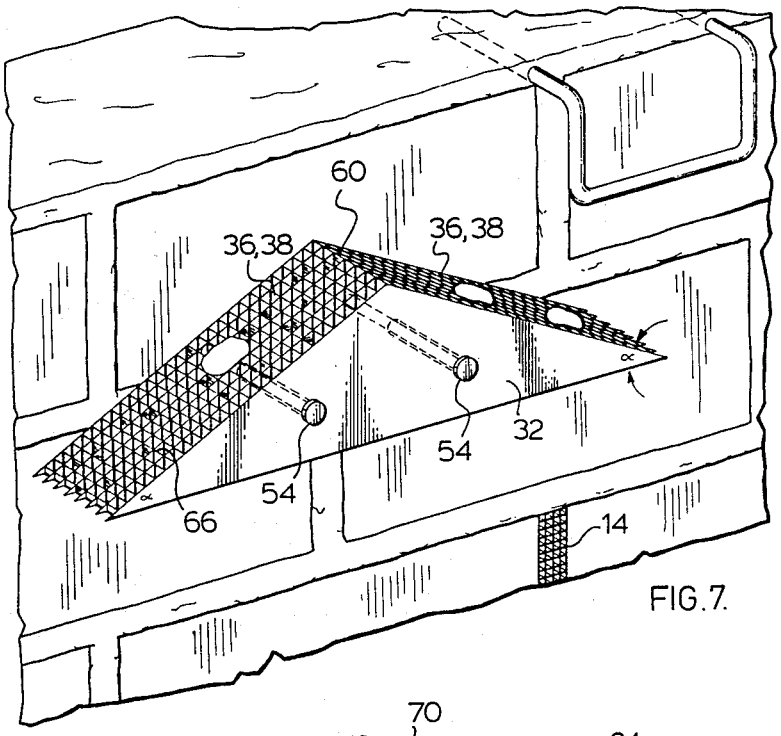
FIG. 7 is a perspective view of a masonry wall under construction, mortar collecting device of FIG. 6.
Figure 9:
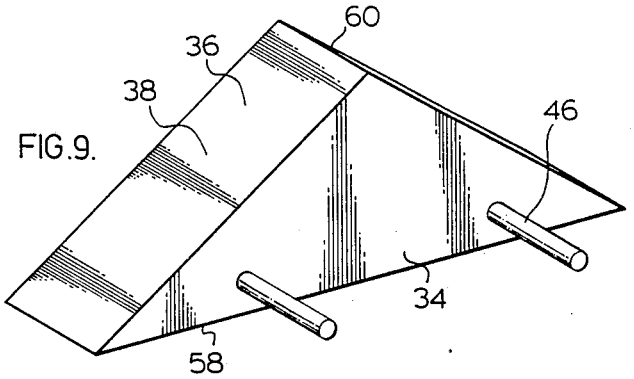
FIG. 9 is a perspective view of a still further embodiment of the mortar collecting device of the present invention.

In regard to the manner of affixing the mortar collecting devices 32 to the inner wall surface 20, such devices 32 may be located in spaced apart relation along rows of masonry brick, as shown in FIG. 2. To provide mortar collecting capability for the wall, spaces 44 intermediate the mortar collecting devices 32*a* and 32*b* along one row would be vertically aligned with mortar collecting devices 32 located in spaced apart relation along another horizontally adjacent row of masonry brick, as shown in FIG. 2, 3 and 7. In this manner, the mortar collecting devices 32 are arranged to collect mortar 10 extruded from between masonry bricks located anywhere along the inner wall surface 20, yet repel moisture collecting on upper surface means 36, and allow such moisture to fall to the bottom row of masonry brick, and thereby pass through weep hole ventilators 14 to the exterior wall surface.

Where the mortar collecting devices 32 are provided with attachment mean 46 outwardly protruding from the planar end surface 34, as shown in FIG. 9, such devices may be placed along the inner wall surface 18 along rows of masonry brick in the manner described above by placing such attachment means 46 on each mortar collecting device 32 into mortar 10 placed intermediate the masonry bricks, to thereby affix the collecting device 32 to the brick wall 18.

Mortar collecting devices of this configuration are thus not limited to being located along spaced intervals along the re-inforcing material 30, which generally is in the form of steel wires having the shape of closed loop stirrup members 30*a*, 30*b*, but rather may be located anywhere along such wall surface making use of such attachment means.

Figure 10:
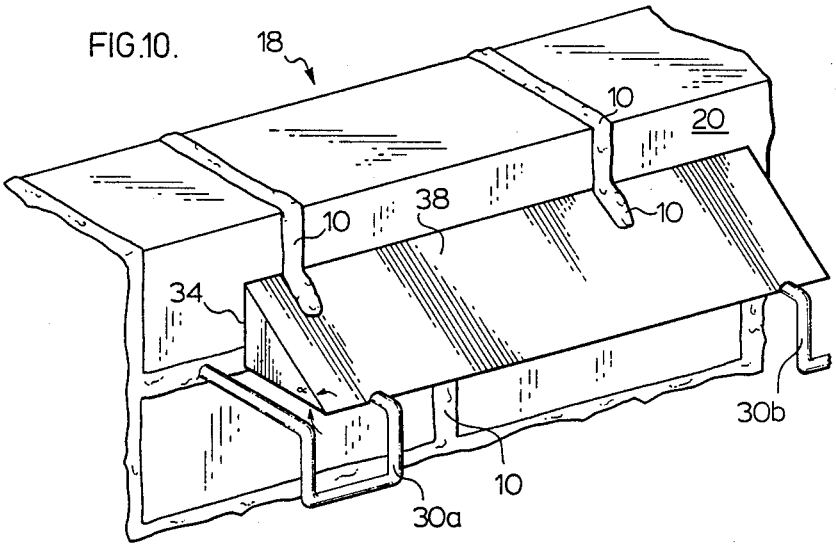
FIG. 10 is a perspective view of a masonry wall showing a still further embodiment of the mortar collecting device of the present invention, located between pairs of mutually spaced apart closed loop stirrup members protruding from the inner surface of said masonry wall.

The method of locating the mortar collecting devices 32 on the masonry wall 18, making use of engaging means 40 located on the mortar collecting device 32, is, however, the preferred method of use of such mortar collecting devices 32, and mortar collecting devices 32 having such engagement means 40 are preferred embodiments of the invention due to the relative simplicity of providing such engagement means 40, which need only be an abutting surface 40*a*, 40*b*, to engage such re-inforcing material 30, as shown in FIGS. 2, 3 and 10.

Figure 8:
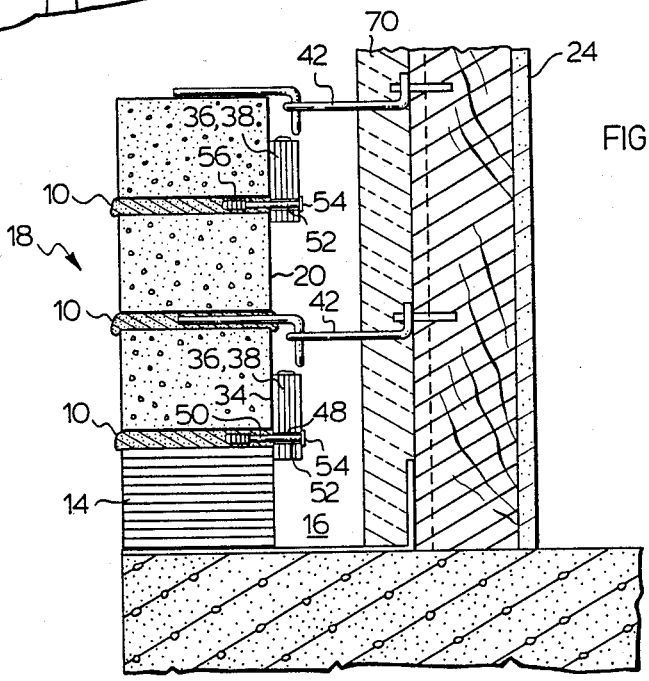
FIG. 8 is a side elevation view of the masonry wall shown in FIG. 7 showing the mortar collecting device of FIG. 7 affixed thereto.

Alternatively, to locate mortar collecting devices 32 elsewhere than along re-inforcing material 30, mortar collecting devices 32 may further be provided with first passageway means 48 adapted to receive connection means 50 to allow said mortar collecting devices to be affixed to the inner wall surface 20, shown in FIGS. 7 and 8. Such first passageway means 48 allows passage of the connection means 50 therethrough, and is substantially perpendicular to the plane of the end surface 34 of the mortar collecting device 32.

The connection means 50 may, in one embodiment thereof, possess a head portion 54 of a size sufficient to prevent passage through said first passageway means 48. Such means may further possess a stem portion 52 affixed at one end to said head portion 54 adapted to allow insertion of said stem portion 52 through the first passageway means 48 and into uncured mortar 10 in the brick wall 18 to allow cementing of the connecting means 50, and thereby the mortar collecting device 32, to the inner wall surface 20. A mortar collecting device 32 incorporating such embodiment is shown in FIG. 6, and its manner of affixation to the masonry wall is shown in FIGS. 7 and 8. As may be seen from FIG. 8, grooves 56 may be added to the stem portion 52 of the connection means to ensure the stem portion 52 remains embedded in the mortar 10.

The connection means 50 need not be limited to a bolt-type connector having a head portion 54 and a stem portion 52, but other connecting means, such as a bracket-type connector, one end thereof being cemented in mortar 10, and the other adapted to engage the mortar collecting device 32, may alternatively be used.

The actual shape of the mortar collecting device 32 may vary. Some variations of the shape are shown in FIGS. 2, 5 and 6. Although the upper surface means 36 may be curved, as shown in FIG. 6, in the preferred embodiment of the invention, such upper surface means 36 is planar, as shown in FIGS. 2, 4, 5, 7, 9 and 10. In a further preferred embodiment, the device 32 is substantially prismatic having 3 sides, one of the 3 sides comprising a base side 58 as shown in FIGS. 2 and 9, the other two remaining sides adjacent said base side 58 comprising upper surface means 36, each of the 2 remaining sides forming an inclined portion 38. The two remaining sides intersect at an apex location 60 vertically above the base side 58. Each of the other two sides form an identical angle with the base side 58, such angle being between approximately 2° and 45°.

In this manner, moisture may be repelled from the both ends 62,64 of the other two sides, rather than being directed toward one end 62 as would result from the configuration shown in FIG. 5.

The base side 58 of the above-described preferred embodiment shown in FIG. 2 is also of a length sufficient to allow opposite ends 62,64 of the base side 58 to span the spaced apart distance of re-inforcing material 30 where such re-inforcing material is the form of spaced apart pairs of closed loop stirrup members 30*a*,*b* protruding from the inner surface of the brick wall.

In a further embodiment, he water-shedding capability of the mortar collecting device 32 may be enhanced by the provision of a plurality of mutually parallel second passageway means 66 extending in a substantially vertical direction when such device is located adjacent said brick wall, said second passageway means 66 having a cross-sectional area sufficiently small to substantially prevent passage of uncured mortar therethrough but of sufficient cross-sectional area to permit passage of moisture therethrough. Usually said second passageway means 66 extend from the upper surface means 36 through the mortar collecting device 32 to a lower surface means, as shown in FIGS. 6 and 7, to allow moisture to pass from the upper surface means and trickle downwardly through said device 32 towards the weep hole ventilators 14 located along the base row 12 of masonry brick. Second passageway means 66 located along the inclined portions 38 of the upper surface means 36 allow any moisture which could become trapped on such inclined portions 38 between lumps of mortar deposited on such surface means 36 to be released from the upper surface means 36 by exiting through the second passageway means 66.

However, where second passageway means 66 are located along the upper surface means 36, it is not necessary that such upper surface means 36 have inclined portions 38. Such upper surface means 36 may in fact be horizontal. The mortar collecting capability of the mortar collecting devices 32 would still be achieved due to the selective operation of the second passageway means 66 in allowing only moisture, and not uncured mortar 10, to pass therethrough.

In respect of dimensions of the passageways means 66, it is necessary that the cross-sectional area thereof be sufficiently small to prevent passage of viscous uncured or cured mortar 10, but of a sufficient cross-sectional area to allow passage of moisture therethrough.

Usually this requires that either of the length, or width of the cross-sectional dimensions of the second passageway means 66, should such cross-sectional area be substantially rectangular, be sufficiently small to prevent passage of mortar therethrough.

It is preferable that the mortar-collecting devices 32 be constructed from a water-resistant, or substantially non-water absorbent material. Ideally, such material is inexpensive, and may be easily cut, cast, or injection-molded to the desired shape. In the preferred embodiment, polyethylene plastic, or polystyrene is used as the component material for the mortar collecting device.

Although the description describes preferred embodiments of the invention, it is not to be limited to such embodiments. Other variations may now become apparent to persons skilled in the art. For a complete definition of the invention, reference should be made to the claims appended to this specification.

What I claim is:

1. A kit for affixing a mortar collecting device to a masonry wall, comprising:

a mortar collecting device, said device comprising:

(i) a substantially planar end surface adapted for placement against a wall surface of said masonry wall;

(ii) upper surface means having an inclined portion which is horizontally inclined when said mortar collecting device is affixed to said masonry wall, said inclined portion being inclined at angles sufficient to shed moisture in the form of water droplets and prevent any substantial amount of said moisture form accumulating on said upper surface means, said inclined portion being sufficiently horizontal to allow retention of mortar falling thereon; and (iii) first passageway means extending through said device substantially perpendicular to the plane of said nd surface; and connection means for affixing said mortar collecting device to said wall comprising:

(i) a head portion of a size sufficient: to prevent passage through said first passageway means; and (ii) a stem portion affixed at one end to said head portion, said stem portion at an end opposite said head portion adapted to be inserted through said first passageway means in said mortar collecting device and into uncured mortar in said masonry wall thereby cementing said connecting means intermediate masonry on said masonry wall and affixing said mortar connecting device to said masonry wall.

2. The mortar collecting device as claimed in claim 1, wherein said device is substantially comprised of a polystyrene.

3. The mortar collecting device as claimed in claim 1, wherein said device is substantially comprised of a polypropylene plastic.

4. A mortar collecting device adapted to collect mortar during construction of a masonry wall, comprising:

upper surface means adapted to collect mortar;

a substantially planar end surface adapted for placement against a wall surface of said masonry wall;

engagement means adapted to engage re-inforcing material protruding from the wall surface of the masonry wall to allow support of said mortar collecting device by said re-inforcing material;

a plurality of passageway means extending through said device in a substantially vertical direction when said device is located adjacent said masonry wall surface, said passageway means each having a cross-sectional area sufficiently small to substantially prevent passage of uncured mortar therethrough but of sufficient cross-sectional area to permit passage of moisture therethrough.

5. A mortar collecting device adapted to collect mortar during construction of a masonry wall, said device comprising:

upper surface means adapted to collect mortar;

a substantially planar end surface adapted for placement against a wall surface of said masonry wall;

attachment means outwardly protruding from said end surface at approximately a 90° angle therewith and integral with said mortar collecting device, said attachment means adapted to be cemented within mortar placed intermediate masonry bricks in said masonry wall to affix said mortar collecting device to said masonry wall; and a plurality of mutually parallel passageway means extending in a substantially vertical direction when such device is located adjacent said masonry wall surface, said passageway means each having a cross-sectional area sufficiently small to substantially prevent passage of uncured mortar therethrough but of sufficient cross-sectional area to permit passage of moisture therethrough.

6. A kit for affixing a mortar collecting device to a masonry wall, comprising:

a mortar collecting device, said device comprising:

(i) a substantially planar end surface adapted for placement against masonry brick wall;

(ii) upper surface means adapted to collect excess mortar falling thereon;

(iii) a plurality of mutually parallel first passageway means extending in a substantially vertical direction when such device is located adjacent said masonry wall surface, said first passageway means having a cross-sectional area sufficiently small to substantially prevent passage of uncured mortar therethrough but of sufficient cross-sectional area to permit passage of moisture therethrough;

connection means for affixing said mortar collecting device to said wall.

7. The kit as claimed in claim 6 said mortar collecting device further comprising first passageway means extending through said device substantially perpendicular to the plane of said end surface, said connection means further comprising:

(i) a head portion of a size sufficient to prevent passage through said passageway means;

(ii) a stem portion affixed at one end to said head portion, said stem portion at an end opposite said head portion adapted to be inserted through said first passageway means in said mortar collecting device and into uncured mortar in said masonry wall thereby cementing said connecting means intermediate masonry on said masonry wall and affixing said mortar connecting device to said masonry wall.

8. The mortar collecting device as claimed in claim 4, wherein said device is comprised of a polyethylene plastic.

9. In a wall construction having an outer masonry wall constructed by laying of masonry with mortar and including weep-hole ventilation means through the wall, said outer masonry wall spaced from an inner wall, the improvement comprising:

a plurality of mortar collecting means secured between the outer masonry wall and the inner wall at a height above the weep-hole ventilation means, said mortar collecting means disposed in two horizontal upper and lower rows with a vertical space therebetween, each mortar collecting means spaced by horizontal spaces from adjacent mortar collecting means of the same row, the mortar collecting means of the lower row located vertically below the horizontal spaces spacing the mortar collecting means of the upper row, said mortar collecting means each having upper surface means to retain mortar falling thereon with the upper surface means of all the mortar collecting means cumulatively to catch and retain thereon substantially all mortar falling between the masonry wall and the inner wall, said vertical space and the horizontal spaces providing passageways for free passage of air and water downward between the mortar collecting means to the weep-hole ventilation means.

10. The improved wall construction of claim 9 wherein said upper surface means retain mortar falling thereon but shed water falling thereon.

11. The improved wall construction of claim 10 wherein said mortar collecting means of the second row have a horizontal extent substantially corresponding to the horizontal extent of the horizontal spaces spacing the mortar collecting means of the upper row.

12. In a wall construction having an outer masonry wall constructed by laying of masonry with mortar and including weep-hole ventilation means through the wall, said outer masonry wall spaced from an inner wall, the improvement comprising:

a plurality of mortar collecting means secured between the outer masonry wall and the inner wall at a height above the weep-hole ventilation means, said mortar collecting means disposed in vertically spaced horizontal rows with a vertical space between each row, each mortar collecting means spaced by horizontal spaces from adjacent mortar collecting means of the same row, the mortar collecting means of one row staggered horizontally relative to the mortar collecting means of the other rows with the mortar collecting means of a lowermost row located vertically below the horizontal spaces spacing the mortar collecting means of the rows thereabove, said mortar collecting means each having upper surface means to retain mortar falling thereon with the upper surface means of all the mortar collecting means cumulatively to catch and retain thereon substantially all mortar falling between the masonry wall and the inner wall, said vertical space and the horizontal spaces providing passageways for free passage of air and water downward between the mortar collecting means to the weep-hole ventilation means.

13. The improved wall construction of claim 12 wherein said mortar collecting means have upper surface means which retain mortar falling thereon but shed water falling thereon.

14. The improved wall construction of claim 13 wherein said upper surface means are inclined at an angle sufficient to shed water and prevent any substantial amount of water from accumulating thereon yet being sufficiently horizontal to retain mortar falling thereon.

15. The improved wall construction of claim 13 wherein each mortar collecting means comprises a plurality of parallel rows of vertically aligned passageway means extending through the mortar collecting means, said passageway means each having a cross-sectional area sufficiently small to substantially prevent passage of uncured mortar therethrough but of sufficient cross-sectional area to permit passage of water therethrough.

16. An improved wall construction as claimed in claim 12 further including reinforcing means extending rearwardly from the masonry wall, said mortar collecting means secured on said reinforcing means.

* * * * *